US011087903B2

(12) United States Patent
Lee et al.

(10) Patent No.: US 11,087,903 B2
(45) Date of Patent: Aug. 10, 2021

(54) TWISTED PAIR CABLE

(71) Applicant: LS CABLE & SYSTEM LTD., Anyang-si (KR)

(72) Inventors: Woo Kyoung Lee, Suwon-si (KR); Jung Jin Kim, Gumi-si (KR); Young Il Cho, Osan-si (KR); Dong Man Jeon, Suwon-si (KR)

(73) Assignee: LS CABLE & SYSTEM LTD., Anyang-si (KR)

( * ) Notice: Subject to any disclaimer, the term of this patent is extended or adjusted under 35 U.S.C. 154(b) by 0 days.

(21) Appl. No.: 16/640,516

(22) PCT Filed: Jan. 22, 2018

(86) PCT No.: PCT/KR2018/000944
§ 371 (c)(1),
(2) Date: Feb. 20, 2020

(87) PCT Pub. No.: WO2019/039677
PCT Pub. Date: Feb. 28, 2019

(65) Prior Publication Data

US 2020/0357539 A1 Nov. 12, 2020

(30) Foreign Application Priority Data

Aug. 25, 2017 (KR) ..... 10-2017-0107948

(51) Int. Cl.
*H01B 11/08* (2006.01)
*H01B 11/04* (2006.01)

(52) U.S. Cl.
CPC ..... *H01B 11/08* (2013.01); *H01B 11/04* (2013.01)

(58) Field of Classification Search
CPC ... H01B 7/02; H01B 7/04; H01B 7/06; H01B 11/02; H01B 11/04; H01B 11/06
USPC ..... 174/110 R, 113 R, 113 C
See application file for complete search history.

(56) References Cited

U.S. PATENT DOCUMENTS 7,196,271 B2 * 3/2007 Cornibert ..... H01B 11/06 174/113 C
7,449,638 B2 * 11/2008 Clark ..... H01B 11/04 174/113 C
7,592,550 B2 * 9/2009 Stutzman ..... 174/113 C
7,838,773 B2 * 11/2010 Vexler ..... H01B 11/06 174/113 R
7,897,875 B2 3/2011 Gareis
(Continued)

FOREIGN PATENT DOCUMENTS

JP 2008520065 A 6/2008
KR 20070028655 A 3/2007
KR 20110081384 A 7/2011

OTHER PUBLICATIONS

International Search Report for related International Application No. PCT/KR2018/000944; report dated Feb. 28, 2019;(7 pages).
(Continued)

*Primary Examiner* — William H. Mayo, III
(74) *Attorney, Agent, or Firm* — K&L Gates LLP

(57) ABSTRACT

The present invention discloses a twisted pair cable in which a shape of a separator for separating a plurality of pairs of wires apart from each other is changed and minimizes internal interference between the pairs of wires.

8 Claims, 6 Drawing Sheets

(56) References Cited

U.S. PATENT DOCUMENTS

| | | | | |
|---|---|---|---|---|
| 2005/0045367 | A1* | 3/2005 | Somers | H01B 11/04<br>174/113 R |
| 2005/0092515 | A1* | 5/2005 | Kenny | H01B 11/08<br>174/113 R |
| 2005/0199415 | A1* | 9/2005 | Glew | H01B 7/295<br>174/113 C |
| 2005/0279528 | A1 | 12/2005 | Kenny et al. | |
| 2007/0044994 | A1* | 3/2007 | Park | H01B 11/06<br>174/113 C |
| 2007/0044995 | A1* | 3/2007 | Park | H01B 11/06<br>174/113 C |

OTHER PUBLICATIONS

Written Opinion for related International Application No. PCT/KR2018/000944; report dated Feb. 28, 2019; (6 pages).

* cited by examiner

TWISTED PAIR CABLE

CROSS-REFERENCE TO RELATED APPLICATIONS

The present application is a National Stage of International Application No. PCT/KR2018/000944, filed Jan. 22, 2018, which claims priority to Korean Application No. 10-2017-0107948, filed Aug. 25, 2017, the disclosure of which are incorporated herein by reference.

FIELD OF THE INVENTION

The present invention discloses a twisted pair cable in which a shape of a separator for separating a plurality of pairs of wires apart from each other is changed and minimizes internal interference between the pairs of wires.

BACKGROUND OF THE INVENTION

An UTP communication cable (an UTP or LAN cable) refers to an unshielded twisted pair cable (hereinafter referred to as a "twisted pair cable"). That is, a twisted pair cable generally used is also referred to as an unshielded pair cable or an unshielded stranded cable. A general twisted pair cable is a standard signal wire used in an LAN card. Such a twisted pair cable may include a core with a plurality of pairs of wires and a sheath covers the outside of the core to protect the core. The twisted pair cable may be classified into category levels (abbreviated as Cat.) according to a transmission rate (Mbps) of a communication signal, and Cat. 3 to Cat. 8 communication cables have been introduced. Specifically, the higher the transmission rate (Mbps) of a signal transmitted via the twisted pair cable, the higher the category level of the cable.

In general, a signal may be transmitted at about 100 Mbps or more via a Cat.5 or higher twisted pair cable. A usable frequency should be increased to about 250 MHz or more to increase a transmission rate of a signal transmitted via a twisted pair cable to 1 Gbps or more which is a transmission rate of a Cat. 6 or higher cable. However, when the usable frequency is increased for high-speed communication, internal interference, e.g., pair-to-pair near-end crosstalk (NEXT) loss or power sum near-end crosstalk (PS NEXT) loss, may increase between pair units inside the twisted pair cable.

To prevent internal interference between the pair units inside the twisted pair cable, a shielding film is formed between the pair units (see FIG. 1 and Korean Patent Publication No. 0330921) or pitches of neighboring pair units are adjusted differently. However, although the shielding film is formed or the pitches of the neighboring pair units are different from each other, a high-frequency signal is transmitted between the pair units and thus internal interference cannot be completely removed when the pitches of the pair units are close to each other.

That is, a method of adjusting pitches is the most reliable method of mitigating internal interference loss but it is not easy to secure a margin within a limited pitch range.

Therefore, in order to secure a sufficient margin of internal interference loss, a method of increasing the distance between defective pairs may be considered. However, in the case of a 4-pair twisted pair cable, there is only one space in which a specific pair of wires can be diagonally disposed, and thus, when internal interference occurs with other two pairs of wires, a solution thereto is required.

A method of forming to various thicknesses a plurality of spacers of a separator for separating pairs of wires in which interference is particularly serious from each other and the like have been introduced as another method of removing internal interference between adjacent pairs of wires. However, an extrusion process of increasing a thickness of a specific spacer during manufacture was not easy to perform and thus was not easily applicable to a product, permittivity increased with an increase in the thickness of the spacer, and all electrical characteristics related to the increased permittivity deteriorated.

BRIEF SUMMARY OF THE INVENTION

The present invention is directed to providing a communication cable in which a shape of a separator for separating a plurality of pairs of wires apart from each other is changed and which is thus easy to manufacture, has a simple configuration, and minimizes internal interference between the pairs of wires.

The present invention provides a twisted pair cable comprising: a plurality of pairs of wires, each of which is formed by spirally twisting two wires together, each of the two wires including a conductor covered with an insulator; a separator disposed between the plurality of pairs of wires, the separator including a plurality of spacers radially formed to separate the pairs of wires apart from each other; and an outer jacket surrounding outsides of the plurality of pairs of wires and the separator, wherein at least one spacer among the plurality of spacers of the separator is different in thickness or length than the other spacers.

And at least one spacer among the plurality of spacers of the separator may be shorter in length than the other spacers.

And at least one spacer among the plurality of spacers of the separator may be greater in thickness than the other spacers.

And at least one spacer among the plurality of spacers of the separator may be greater in thickness than the other spacers and is shorter in length than the other spacers.

And a length of the at least one separator which may be thicker and shorter is greater than a diameter of the pairs of wires.

And cross-sectional areas of four spacers with respect to a point of intersection on center lines of the spacers in a thickness direction may correspond to each other within a predetermined error range.

And the predetermined error range may be 25%.

And the plurality of pairs of wires may be each formed by twisting two wires together at different pitches, and the at least one spacer different in thickness or length than the other spacers may be disposed between pairs of wires having a minimum pitch deviation among the plurality of pairs of wires.

The present invention provides a separator for separating pairs of wires of a twisted pair cable apart from each other, wherein the twisted pair cable comprises four pairs of wires, and the separator comprises four spacers forming a cross-shaped cross-section together, wherein at least one spacer among the four spacers is different in thickness or length than the other spacers, wherein cross-sectional areas of the spacers with respect to a point of intersection on center lines of the spacers in a thickness direction correspond to each other within a 25% range.

In a twisted pair cable according to the present invention, a shape of a separator is partially changed to increase the distance between pairs of wires in which internal interference is serious without additionally forming a shielding layer, thereby solving an internal interference problem, to reduce total effective permittivity of the twisted pair cable so as to compensate for a decrease in a propagation speed, and to make cross-sectional areas of spacers the same with respect to a reference point on the spacers, thereby ensuring high productivity in an extrusion process.

DETAILED DESCRIPTION OF THE INVENTION

Hereinafter, exemplary embodiments of the present invention will be described in detail with reference to the accompanying drawings. The present invention is, however, not limited thereto and may be embodied in many different forms. Rather, the embodiments set forth herein are provided so that this disclosure will be thorough and complete, and fully convey the scope of the invention to those of ordinary skill in the art. Throughout the specification, the same reference numbers represent the same elements.

Figure 1:
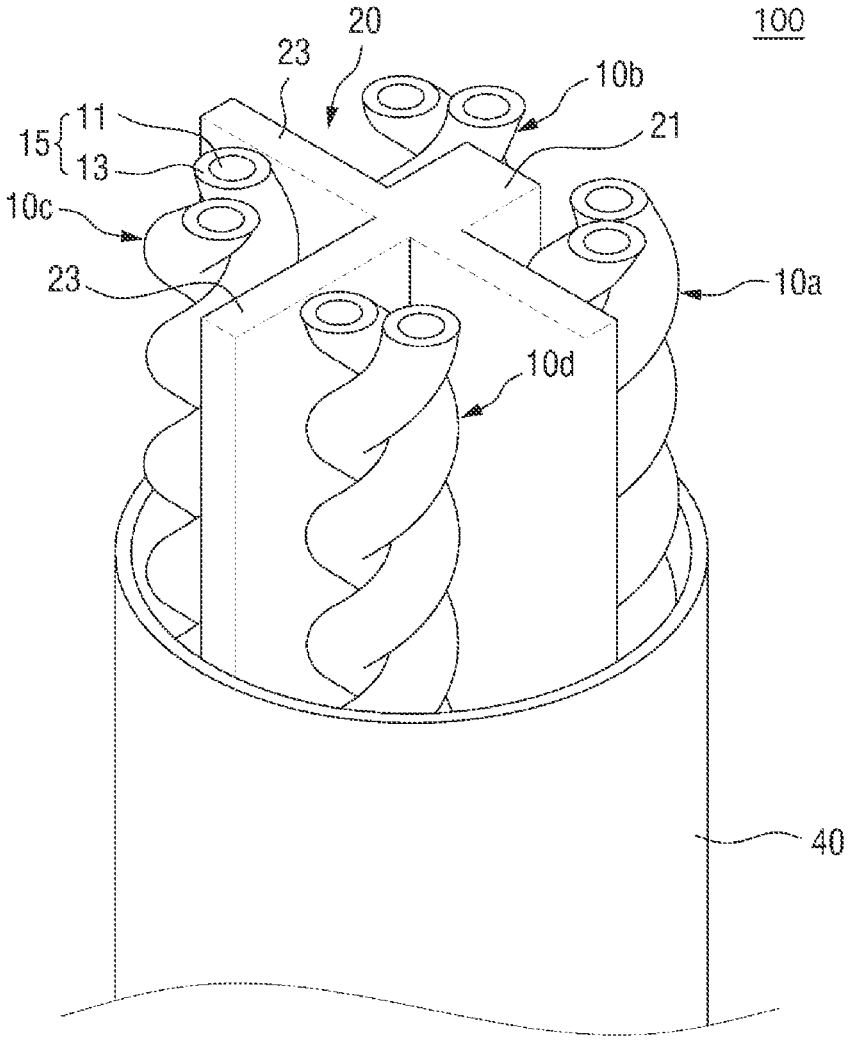
FIG. 1 is a perspective view of a state in which an outer jacket of a twisted pair cable according to the present invention is stripped off.

FIG. 1 is a perspective view of a state in which an outer jacket 40 of a twisted pair cable 100 according to the present invention is stripped off.

The twisted pair cable 100 according to the present invention includes a plurality of pairs of wires 10, each of which is formed by spirally twisting two wires 15 each composed of a conductor 11 covered with an insulator 13; a separator 20 disposed between the plurality of pairs of wires 10 and having spacers formed radially to separate the pairs of wires 10 apart from each other; and an outer jacket 40 surrounding the outsides of the plurality of pairs or wires 10 and the separator 20. At least one among the spacers of the separator 20 may be different in thickness or length than the other spacers.

The twisted pair cable may include the plurality of pairs of wires 10 to perform a communication function. Each pair of wires 10 may be formed by twisting a pair of wires 15 together.

Each pair of wires 10 may be configured by twisting a pair of wires 15 together at predetermined different twist pitches, and each of the pair of wires 15 may be configured by covering the conductor 11 with the insulator 13.

The conductor 11 constituting the wire 15 may be formed of aluminum, copper, or annealed copper wire. In general, a diameter of the conductor 11 is 24 AWG. As the diameter of the conductor 11 decreases, a capacitance (C) decreases and a resistance of the conductor 11 increases and thus an attenuation increases.

The insulator 13 covering the conductor 11 to form the wire 15 may be low-density polyethylene (LDPE), medium-density polyethylene (MDPE), high-density polyethylene (HDPE), or the like. Insulators 13 of different colors may be used to configure wires 15 of different colors.

The twisted pair cable is generally composed of four pairs of wires but the number of wires may be increased or decreased. For example, the twisted pair cable may consist of 25 pairs of wires.

As illustrated in FIG. 1, the separator 20 may be provided between four pairs of wires 10.

The separator 20 may include four spacers 21 and 23 to separate the pairs of wires 10 apart from each other and to provide a physical space for accommodation of the pairs of wires 10.

The separator 20 of FIG. 1 may include four spacers 21 and 23 forming a cross-shaped cross-section, and the pairs of wires 10 of the conductors 11 may be placed in regions partitioned by the cross-shaped spacers 21 and 23.

Generally, characteristics impedance for each pair of wires of conductors or between pairs of wires, propagation delay, delay skew, attenuation, pair-to pair near-end cross-talk (NEXT) loss, power sum near-end crosstalk (PS NEXT) loss, pair-to pair equal-level far-end crosstalk (ELFEXT) loss, return loss, etc. of the twisted pair cable should be considered in terms of electrical characteristics.

In particular, in order to solve NEXT loss due to internal interference between pairs of wires constituting cores, a method of securing sufficient distances between the pairs of wires or a method of providing a shielding layer for each pair of wires may be used.

The NEXT loss is a measure of undesired signal coupling occurring between adjacent pairs of wires of the twisted pair cable, and the smaller the signal coupling, the better the performance.

The NEXT loss, which may become more serious as the distance between the pairs of wires 10 decreases, becomes worse as a grade is increased according to a communication speed.

The latter method of providing a shielding layer for each pair of wires to solve NEXT loss is directly related to costs and a diameter of the cable and thus the present invention suggests a method of simplifying a structure of a separator to minimize NEXT loss.

Therefore, when shielding means is not used for each pair of wires 10, the distances between the pairs of wires 10 should be increased to alleviate NEXT, and the separator 20 separates the pairs 10 of wires to be spaced apart from each other so that the distances between the pairs of wires 10 may be increased, thereby minimizing internal interference loss, i.e., NEXT loss.

A thickness or length of at least one among the plurality of spacers of the twisted pair cable 100 according to the present invention may be set to be different from those of the other spacers. This will be described in detail with reference to FIG. 2 below.

In general, as a grade of a cable is increased, the thickness or length of the spacers of the separator 20 should be increased to increase the distances between the pairs of wires 10 so that internal interference such as NEXT may be alleviated but permittivity and the diameter of the cable increase, and thus, the thickness or length of the spacers may be appropriately controlled.

Cores of the twisted pair cable which include the plurality of pairs of wires 10 and the separator 20 may be covered with an outer jacket. The outer jacket may be formed of polyvinyl chloride or low smoke zero halogen (LSZH) or low smoke free of halogen.

Figure 2:
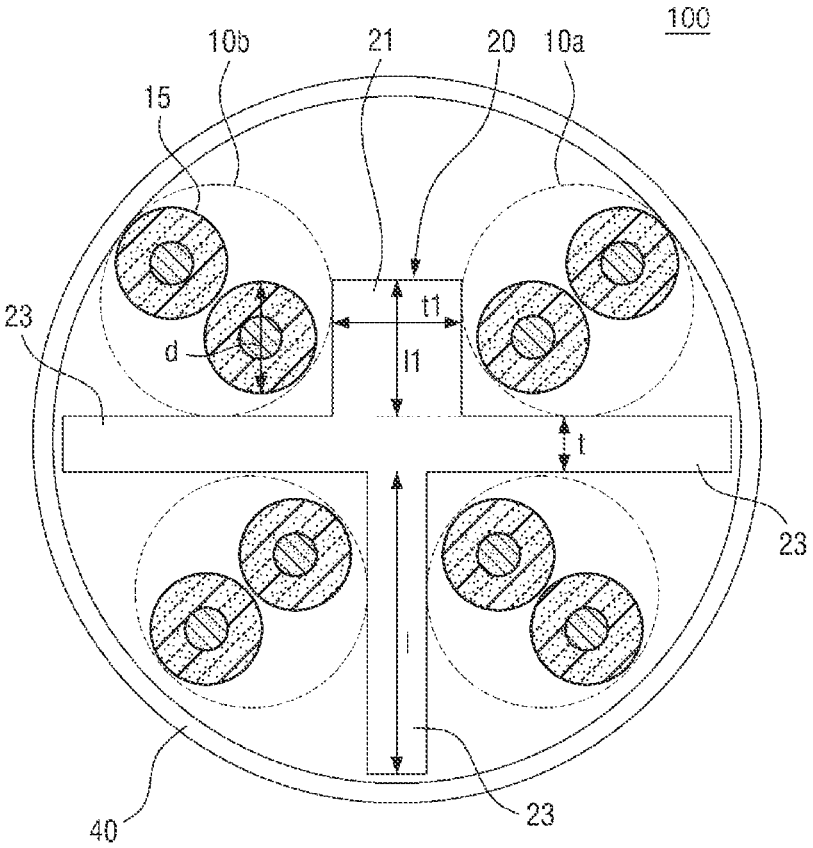
FIG. 2 is a cross-sectional view of a twisted pair cable according to an embodiment of the present invention.
Figure 3:
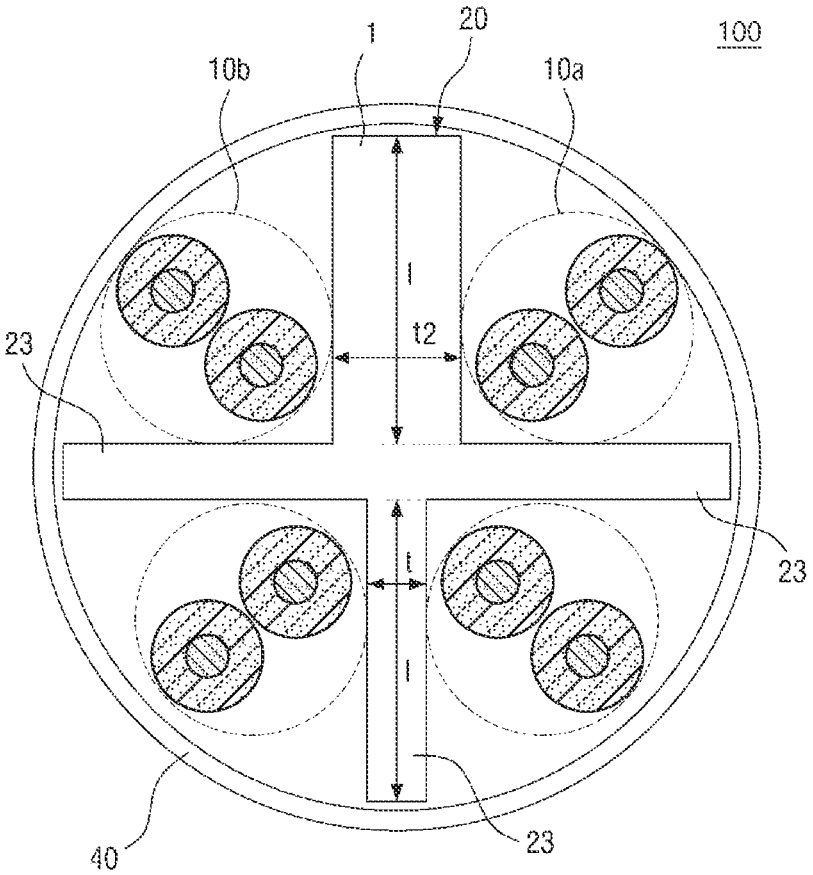
FIGS. 3 and 4 illustrate twisted pair cables according to other embodiments of the present invention.
Figure 4:
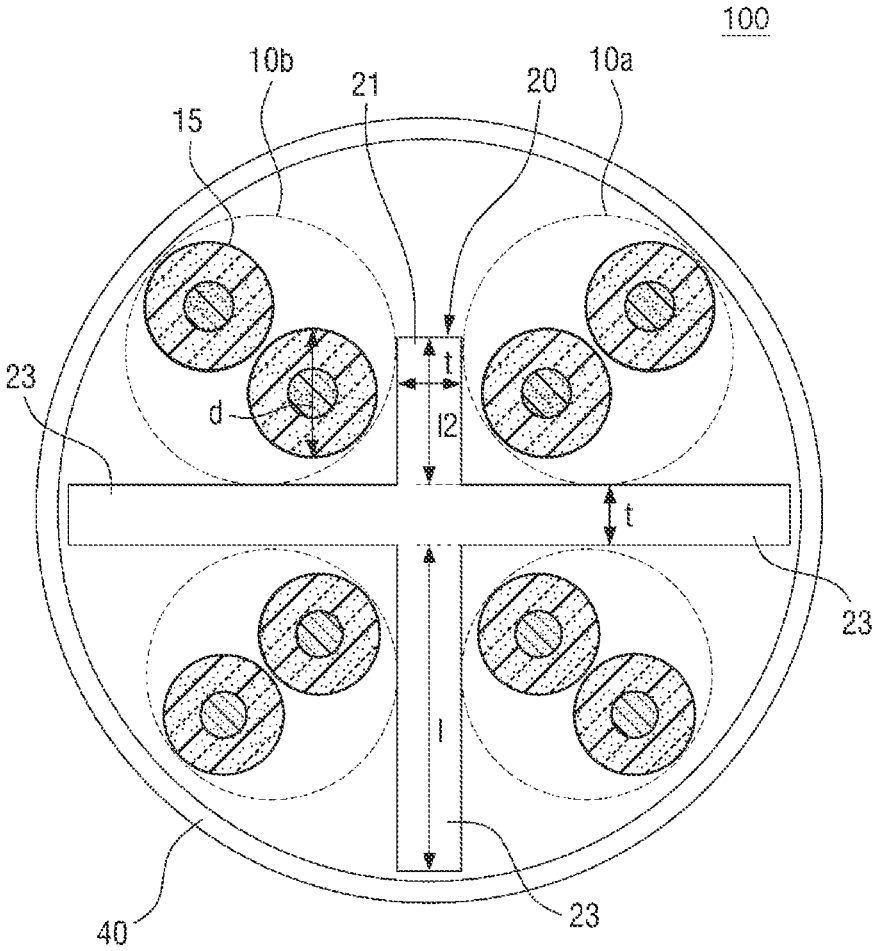

FIG. 2 is a cross-sectional view of a twisted pair cable 100 according to an embodiment of the present invention, and FIGS. 3 and 4 illustrate twisted pair cables 100 according to other embodiments of the present invention.

As described above, a thickness or length of at least one among a plurality of spacers of a separator 20 of a twisted pair cable 100 according to the present invention may be set to be different from those of the other spacers.

The separator 20 of the twisted pair cable of FIG. 2 includes four spacers, i.e., first to fourth spacers 21 and 23. A first pair of wires 10*a* to a fourth pair of wires 10*d* may be accommodated in spaces partitioned by these spacers.

As illustrated in FIG. 2, a thickness t1 of the first spacer 21 among the four spacers 21 and 23 may be greater than a thickness t of the second to fourth spacers 23, and a length 11 thereof may be less than a length 1 of the second to fourth spacers 23.

When there is internal interference loss between the pairs of wires 10*a* to 10*d*, e.g., when a level of NEXT loss between the first pair of wires 10*a* and the second pair of wires 10*b* is greater than or equal to a predetermined level, it is necessary to increase the distance between the first pair of wires 10*a* and the second pair of wires 10*b*.

Each of a plurality of pairs of wires may be configured by twisting wires together to have a different pitch, and NEXT loss may occur between pairs of wires having a similar pitch among the plurality of pairs of wires. Accordingly, at least one spacer having a different thickness or length among spacers of the separator 20 of the twisted pair cable according to the present invention is preferably disposed between pairs of wires having a minimum pitch deviation among the plurality of pairs of wires.

Therefore, the first pair of wires 10*a* and the second pair of wires 10*b* may be pairs of wires having a minimum twist pitch deviation among the four pairs of wires, and the distance therebetween may be increased by increasing a thickness of the spacer 21 between the first pair of wires 10*a* and the second pair of wires 10*b* to minimize NEXT loss or the like, which may occur due to the minimum twist pitch deviation. Furthermore, the length of the spacer 21 may be reduced to reduce effective permittivity, thereby improving various electrical characteristics.

The twisted pair cable of FIG. 3 has the same conditions as the twisted pair cable of FIG. 2 except that(ok?) a thickness t2 of a first spacer 21 is greater than a thickness t of second to fourth spacers 23.

When only the thickness t2 of the first spacer 21 is increased, the distance between a first pair of wires 10*a* and a second pair of wires 10*b* increases, thus reducing NEXT loss between the pairs of wires 10*a* and 10*b*, but an inner space of the twisted pair cable is reduced by the increase in the thickness t2 of the first spacer 21. The reduction in the inner space refers to an increase in effective permittivity.

Assuming that the other conditions of the twisted pair cables of FIGS. 2 and 3 are the same, effective permittivities thereof are compared as follows.

When permittivity of air is εa, permittivity of the separator 20 is εd, a total cross-sectional area of the twisted pair cable is A, and a cross-sectional area of the separator 20 is B, effective permittivity εe of the twisted pair cable of FIG. 3 may be expressed by Equation (1) below.

$$\varepsilon_e = \frac{B}{A} \times \varepsilon_d + \frac{A-B}{A} \times \varepsilon_{a=} \varepsilon_a + \frac{B*(\varepsilon_d - \varepsilon_a)}{A} \quad (1)$$

In the case of the cable of FIG. 2, assuming that the thickness of the first spacer 21 is the same as that of the first spacer 21 of FIG. 3 and a length thereof is shorter in length than that of the first spacer 21 of FIG. 3 and thus a cross-sectional area of the separator 20 is reduced by ΔB (here, B>ΔB), effective permittivity εe of the twisted pair cable of FIG. 3 may be expressed by Equation (2) below.

$$\varepsilon_e = \varepsilon_a + \frac{(B-\Delta B)*(\varepsilon_d - \varepsilon_a)}{A} \quad (2)$$

Accordingly, when the other conditions are the same, the total cross-sectional area of the separator 20 is reduced by AB when only the length of the first spacer 21 is reduced, and thus, total effective permittivity of the cable is reduced by $\Delta B*(\varepsilon_d-\varepsilon_a)/A$.

Accordingly, the twisted pair cables of FIGS. 2 and 3 may achieve the same effect of preventing loss of internal interference, such as NEXT, between the first pair of wires 10*a* and the second pair of wires 10*b* but total effective permittivities $\Delta B*(\varepsilon_d-\varepsilon_a)/A$ thereof may be different from each other.

When the effective permittivity $\varepsilon_e$ decreases, an effect of compensating for the propagation speed of the twisted pair cable.

That is, a problem such as NEXT may be solved by increasing the distance between the pairs of wires 10 of the twisted pair cable in which internal interference occurs, and effective permittivity may be reduced by increasing a thickness of the spacer between these pairs of wires 10 may be increased and reducing a length thereof.

Therefore, in the twisted pair cable 100 according to the present invention, a thickness or length of at least one among the spacers of the separator 20 may be set to be different from those of the other spacers so as to reduce internal interference loss or effective permittivity.

In the embodiment of FIG. 4, the four spacers 21 and 23 of the separator 20 are the same in thickness but the first spacer 21 is shorter in length than the other spacers 23.

When internal interference between adjacent pairs of wires 10 is particularly serious, the thickness of the separator between these pairs of wires 10 may be increased to be greater than those of the other spacers as illustrated in FIG. 3. When effective permittivity should be reduced to compensate for a propagation speed, at least one of the spacers of the separator 20 may be reduced without changing the thickness of the spacers as illustrated in FIG. 4.

An effect of reducing effective permittivity of the cable by a reduction in the cross-sectional area of the separator 20 may be also obtained in this case.

In addition, in the embodiments of in FIGS. 2 and 4, even when the length of a specific spacer of the separator 20 is reduced to reduce effective permittivity, the length 11 or 12 of the first spacer 21 shorter in length than the other spacers 23 is preferably greater than a diameter of the unit wire 15 of each pair of wires 10 so as to secure an effect of separating the pairs of wires 10 apart from each other. When the length of the first spacer 21 is greater than the diameter of the unit wire 15, it was confirmed that the pairs or wires 10 was maintained spaced apart from each other.

Figure 5:
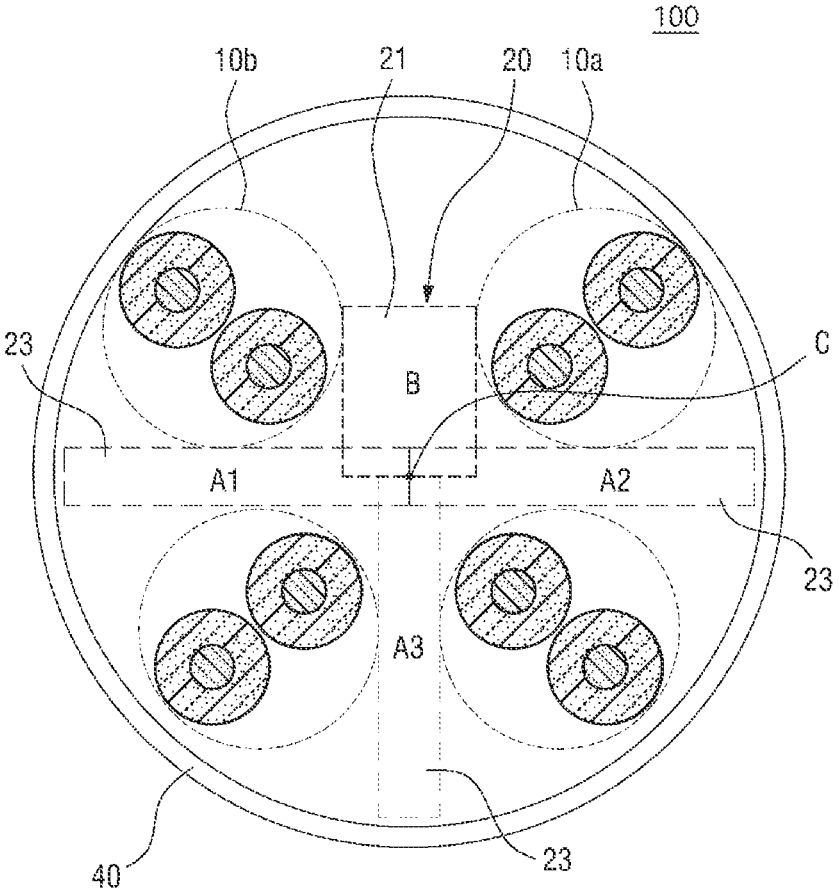
FIG. 5 illustrates division of a cross-sectional area of a separator of the twisted pair cable of FIG. 2 with respect to a reference point on spacers of the separator.

FIG. 5 illustrates division of a cross-sectional area of the separator 20 of the twisted pair cable of FIG. 2 with respect to a reference point on spacers of the separator 20.

As described above, when internal interference between adjacent pairs of wires 10 is particularly serious, the thickness of the spacer of the separator 20 between pairs of wires 10 in which internal interference occurs may be increased to be greater than that of the other spacers as illustrated in FIG. 3. When effective permittivity should be reduced to compensate for a propagation speed due to a reduction in a twist pitch due to an increase in a communication level, a length of at least one spacer of the separator 20 may be reduced without changing the thickness of the spacers of the spacer 20 as illustrated in FIG. 4.

However, because the separator 20 is manufactured by an extrusion process, a cross-sectional area of a region of an extrusion mold corresponding to the first spacer 21 is large and thus has a low extrusion resistance when a shape of an extrusion opening of the extrusion mold is configured similar to the separator 20 of FIG. 3 so as to increase only the thickness of a specific spacer as shown in FIG. 3. Therefore, an extrusion material may be concentrated on this region and thus is not uniformly supplied to regions of the extrusion mold corresponding to the second to fourth spaces 23, thus making it difficult to make the separator 20 intact.

In contrast, when only a specific spacer is configured to be shorter, an extrusion resistance of a corresponding region of the extrusion mold increases and thus the first spacer 21 may not be formed intact.

To solve this problem, as in the embodiments of FIGS. 2 and 5, cross-sectional areas of the four spacers with respect to a point of intersection on central lines of the spacers 21 and 23 in a thickness direction preferably correspond to each other within a predetermined error range.

A pressure applied to the extrusion material at the extrusion opening of the extrusion mold may be highest at the point of intersection and be dispersed in four directions with respect to the point of intersection.

Therefore, in order to make a flow resistance uniform in the first spacer 21 to fourth spacers 23 in terms of the flow of the extrusion material, a method of setting cross-sectional areas of the regions of the extrusion opening of the extrusion mold corresponding to the first spacer 21 to the fourth spacers 24 to be substantially the same may be considered.

That is, when the extrusion opening of the extrusion mold is formed in a shape corresponding to the cross-sectional areas of the four spacers with respect to the point of intersection on the center lines in the thickness direction, which correspond to each other within the predetermined error range, flow resistances at the regions of the extrusion openings corresponding to the spacers may be uniform and thus the first spacer 21 to the fourth spacer 23 may be extruded intact as illustrated in FIG. 5.

Therefore, it was found that the spacers 21 to 23 were manufactured intact in shape when the separator 20 was designed such that cross-sectional areas A1, A2, A3 and B of the second to fourth spacers 23 and the first spacer 21 are the same and extrusion is performed by an extrusion mold having a shape corresponding to that of the separator 20.

In addition, it was experimentally found that an error rate between the shape of the extrusion opening of the extrusion mold and a shape of the separator 20 when extruded may be about 25% or less due to friction between an extrusion material and the mold or the like, and thus, a cross-sectional area of each spacer of the separator 20 with respect to a point of intersection C preferably falls within a 25% range.

Figure 6:
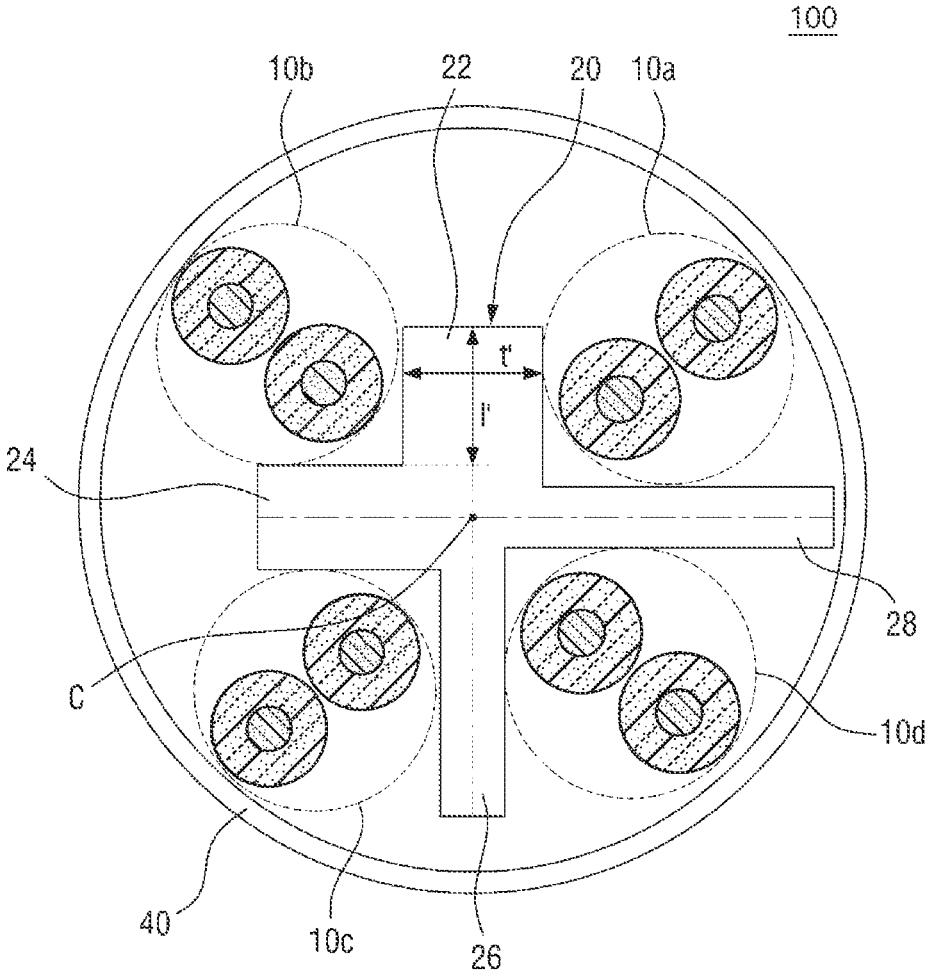
FIG. 6 is a cross-sectional view of a twisted pair cable according to another embodiment of the present invention.

FIG. 6 is a cross-sectional view of a twisted pair cable 100 according to another embodiment of the present invention.

In the twisted pair cables 100 of FIGS. 2 and 5 according to the present invention, the four spacers each have a corresponding cross-sectional area within the predetermined error range with respect to the point of intersection C on the center lines of the spacers in the thickness direction, and only the thickness of the first spacer 21 is increased and a length thereof is reduced.

However, when there are several pairs of wires 10 in which internal interference occurs among the four pairs of wires 10 of one twisted pair cable, a thickness or length of each of the spacers may be variously changed.

That is, as illustrated in FIG. 6, thicknesses of these spacers decrease and lengths thereof (a minimum length thereof relative to an adjacent spacer) increase in the order of a first spacer 22, a second spacer 24, a third spacer 26, and a fourth spacer 28. However, similarly, in the twisted pair cable of FIG. 6, cross-sectional areas of the four spacers with respect to a point of intersection on center lines of the spacers in a thickness direction correspond to each other within a predetermined error range, and thus, the distance between the pairs of wires 10 may be adjusted according to a degree of internal interference between adjacent pairs of wires 10 or the cross-sectional areas of the spacers with respect to the point of intersection may be controlled to the same while controlling total effective permittivity of the cable, thereby securing productivity.

While the present invention has been described above with respect to exemplary embodiments thereof, it would be understood by those of ordinary skilled in the art that various changes and modifications may be made without departing from the technical conception and scope of the present invention defined in the following claims. Thus, it is clear that all modifications are included in the technical scope of the present invention as long as they include the components as claimed in the claims of the present invention.

The invention claimed is:

1. A twisted pair cable comprising:

a plurality of pairs of wires, each of which is formed by spirally twisting two wires together, each of the two wires including a conductor covered with an insulator;

a separator disposed between the plurality of pairs of wires, the separator including a plurality of spacers radially formed to separate the pairs of wires apart from each other; and an outer jacket surrounding outsides of the plurality of pairs of wires and the separator, wherein at least one spacer among the plurality of spacers of the separator is greater in thickness than the other spacers and is shorter in length than the other spacers, wherein cross-sectional areas of the plurality of spacers with respect to a point of intersection of center lines of the spacers in a thickness direction correspond to each other, and wherein one spacer having a maximum thickness among spacers of the separator is disposed between pairs of wires having a minimum pitch deviation among the plurality of pairs of wires.

2. The twisted pair cable of claim 1, wherein at least one spacer among the plurality of spacers of the separator is shorter in length than the other spacers.

3. The twisted pair cable of claim 1, wherein at least one spacer among the plurality of spacers of the separator is greater in thickness than the other spacers.

4. The twisted pair cable of claim 2, wherein a length of the at least one separator which is thicker and shorter is greater than a diameter of the wire which consists of pairs of wires.

5. The twisted pair cable of claim 1, wherein the cross-sectional areas of the four spacers of the plurality of spacers correspond to each other within a predetermined error range.

6. The twisted pair cable of claim 5, wherein the predetermined error range is 25%.

7. The twisted pair cable of claim 1, wherein the plurality of pairs of wires are each formed by twisting two wires together at different pitches, and the at least one spacer different in thickness or length than the other spacers is disposed between pairs of wires having a minimum pitch deviation among the plurality of pairs of wires.

8. A separator for separating pairs of wires of a twisted pair cable apart from each other, wherein the twisted pair cable comprises four pairs of wires, and the separator comprises four spacers forming a cross-shaped cross-section together, wherein at least one spacer among the four spacers of the separator is greater in thickness than the other spacers and is shorter in length than the other spacers, and wherein cross-sectional areas of the four spacers with respect to a point of intersection on center lines of the four spacers in a thickness direction correspond to each other, and wherein one spacer having a maximum thickness among spacers of the separator is disposed between pairs of wires having a minimum pitch deviation among the plurality of pairs of wires.

* * * * *